US005573029A

United States Patent [19]

Freimann

[11] Patent Number: 5,573,029

[45] Date of Patent: Nov. 12, 1996

[54] METHOD AND DEVICE FOR A PIPE FLOW UNDER PRESSURE WHICH IS TO BE DIVERTED OR BRANCHED

[76] Inventor: Robert Freimann, Ahamer Str. 63, 84453 Mühldorf, Germany

[21] Appl. No.: 446,823

[22] PCT Filed: Oct. 7, 1994

[86] PCT No.: PCT/EP94/03315

§ 371 Date: Jun. 1, 1995

§ 102(e) Date: Jun. 1, 1995

[87] PCT Pub. No.: WO95/11387

PCT Pub. Date: Apr. 27, 1995

[30] Foreign Application Priority Data

Oct. 19, 1993 [DE] Germany ..... 43 35 595.1

[51] Int. Cl.[6] ..... F15C 1/16

[52] U.S. Cl. ..... 137/1; 137/810; 137/812; 137/833

[58] Field of Search ..... 137/810, 811, 137/812, 833, 1, 14

[56] References Cited

U.S. PATENT DOCUMENTS

| | | | |
|---|---|---|---|
| 3,373,759 | 3/1968 | Adams | 137/810 |
| 3,493,003 | 2/1970 | Peoples | 137/810 |
| 3,507,296 | 4/1970 | Fix et al. | 137/812 |
| 3,515,158 | 6/1970 | Utz | 137/812 |
| 4,112,977 | 9/1978 | Syred et al. | 137/812 |

*Primary Examiner*—A. Michael Chambers
*Attorney, Agent, or Firm*—George W. Dishong

[57] ABSTRACT

The invention relates to a device with diversion or branching of a pipe flow under pressure with a height-adjustable built-in part and a swirl chamber which tapers from the region of the tangential inlet to the axial outlet of the flow, and is characterized in that, for simultaneous action with virtually any spiral movement distributed over the cross-section and for controlling the pressure distribution in the swirl flow and thus in the axial outlet opening, the built-in part (3) is inserted into the swirl chamber (5) adjustably in its eccentricity in relation to the swirl chamber axis.

22 Claims, 2 Drawing Sheets

FIG. 1
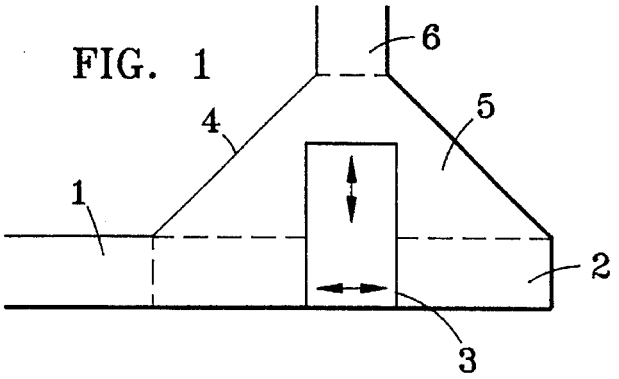
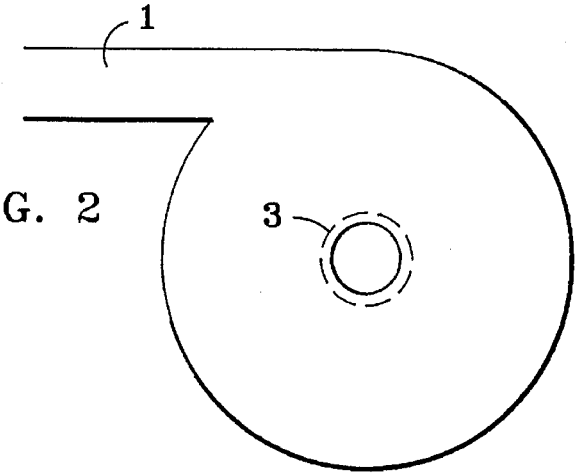
FIG. 2
FIG. 3
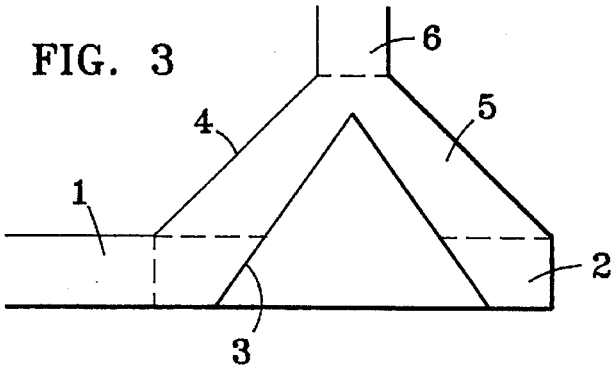
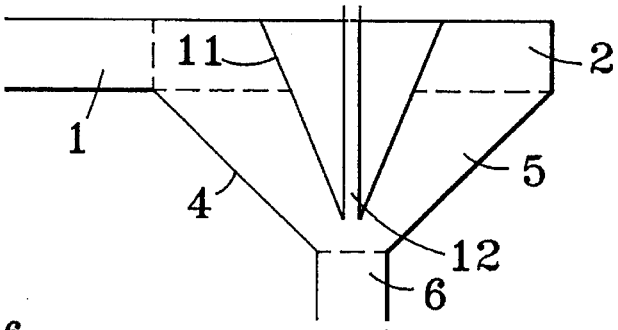
FIG. 4
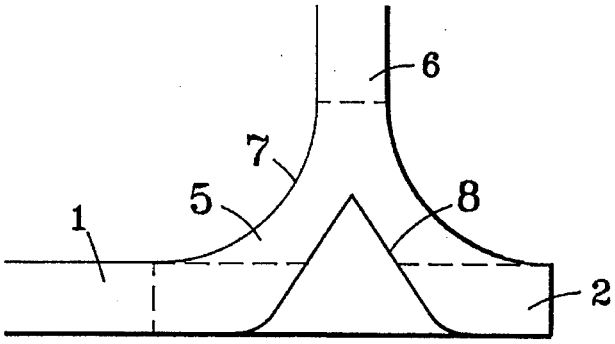
FIG. 5

METHOD AND DEVICE FOR A PIPE FLOW UNDER PRESSURE WHICH IS TO BE DIVERTED OR BRANCHED

FIELD OF THE INVENTION

The invention relates to a method in which a pipe flow under pressure is imparted a spiral movement and subsequently an axial pipe flow is obtained, the incoming flow being directed towards a height-adjustable flow guide.

BACKGROUND OF THE INVENTION

The subject of the invention is also a device with diversion or branching of a pipe flow under pressure with a height-adjustable built-in part and a swirl chamber which tapers from the region of the tangential inlet to the axial outlet of the flow.

Lastly, the subject of the invention is also the application of the device of the method to the incoming flow of inlets for circular tanks, sand classifiers, vortex separators, hydrocyclones or vortex cleaners, centrifugal force separators, hydrocyclone separators as well as distributor structures for incoming water masses.

Such methods and devices are used in the case of both water and waste water, or more specifically in water engineering in domestic supplies as well as in laboratory and process technology.

Rotationally symmetrical spiral movements are advantageous in various applications and methods in hydraulics. Such tasks arise both in water engineering and in domestic water supplies and in laboratory and process technology. In the waste water area, it is mostly a uniform loading of various tanks which is desired, whereas in laboratory and process technology a stable spiral movement in pipe runs can be advantageous or even only trigger a desired effect, such as e.g. a separating process. The disadvantage of previously used swirl chamber shapes (e.g. according to Adami, Drioli, Knapp, Thoma etc.) for such applications lies in a rotational symmetry, which is marked to a greater or lesser extent, by the rotary movement. The reason for this is found in the non-uniform pressure distribution over the swirl-chamber circumference and the inadequate pressure redistribution on the transition from the tangential to the axial pipe. As a result, the vortex core, which is forming and consists of air or liquid, is deflected to one side.

The tangential incoming flow of a conventional swirl chamber with a flat bottom and a cover has the consequence that a spiral vortex is formed in the swirl chamber. The water layers adjacent to the bottom and the cover undergo, as a result of the wall friction, a braking of their speed of rotation and consequently a reduction in their centrifugal force. They therefore head in steeper spirals for the center where they are caught by the central layers and pulled away from the outlet opening again by the suddenly increased centrifugal force. In this manner, centripetal, swirling flows arise in the vicinity of the bottom and the cover and centrifugal, swirling flows in the center between bottom and cover. As a result of the non-uniform pressure match in the region of the tangential mouth, the force effects described above take place distributed non-uniformly over the cross-section, in other words eccentrically. This eccentricity then leads, depending on the throughput, to the asymmetrical rotary movement in the subsequently axial pipe.

It is not unappreciated that a method and a device for generating a spiral fluid flow are known per se (DE-OS 36 30 536). In this case, however, the aim is to superimpose a spiral movement on a straight pipe flow in order that the object remains rotationally symmetrical. Whether the means indicated therein are adequate to bring about rotational symmetry at all is questionable because the inflow is precisely not symmetrical but tangential. The flow, which arrives for example from below according to this laid open specification, enters into a widening, in the broadest sense a "swirl chamber"; a small flow comes from the side as a pulse flow which influences the main flow via a small rotationally symmetrical gap.

The device explained in DE-OS 36 30 536 can thus, as it is described and illustrated, not function. Moreover, a further asymmetrical part would be necessary here for handling the asymmetrical flow. In a device such as that known from DE-OS 36 30 536, the considerations begin, which have led to the invention.

SUMMARY OF THE INVENTION

The object of the invention is, by means of a simple construction with low outlay, to bring about a rotationally symmetrical or any eccentric, spiral movement of a liquid in the axial pipe attached to a swirl chamber simply by pressure redistribution and flow diversion independently of the throughput.

This aim is achieved according to the invention by a device with diversion or branching of a pipe flow under pressure with a [sic] vertical position adjustable built-in part and a swirl chamber which tapers from the region of the tangential inlet to the axial outlet of the flow, in that, for simultaneous action with virtually any spiral movement distributed over the cross-section and for controlling the pressure distribution in the swirl flow and thus in the axial outlet flow, the built-in part is inserted into the swirl chamber adjustably in its eccentricity in relation to the swirl chamber axis.

In terms of process technology, this aim is achieved according to the invention in that, to achieve virtually any spiral movement distributed over the cross-section, the flow is diverted or branched, by the outgoing flow, which leaves perpendicularly to the tangential incoming flow, being brought about from the latter by directing the flow, and in that the flowthrough area for the swirl flow is tapered in the direction of the axial flow and, in the region where swirl is applied, the flow is guided around a flow guide and straightener which is adjustable with regard to the eccentricity in relation to the swirl chamber axis.

By means of the measures according to the invention, therefore, a special swirl chamber shape is produced, which makes possible a pressure redistribution to compensate the irregularities described above over a spiral plane.

Starting from the plane of one or more tangential inlets to the transition into the axial outlet, the swirl chamber tapers conically which has the consequence that the flowthrough area of the swirl chamber, which is initially great, becomes continuously smaller in the axial direction to the outlet opening and thus a pressure compensation takes place over the flow cross-section in the axial direction. With regard to a directed forced flow, this pressure redistribution can be brought about by the installation of the cylinder or cone, the axis of symmetry of the cone or cylinder being arranged eccentrically in relation to the axis, prolonged into the swirl chamber, of the axial pipe.

Advantageously, the cone envelope is inclined more steeply than the swirl chamber edges. However, it must be at least just as greatly inclined in order to avoid an increase in the flow cross-section. For this reason, the cone point or the cylinder should expediently end below the transition to the axial pipe in order to make space available for the pressure redistribution up to the axial outlet.

According to the invention, the swirl chamber preferably comprises, for generating a rotationally symmetrical or virtually any eccentric, spiral movement in liquids, in particular water:

a) a circular swirl chamber base, the diameter of which depends on the size of the tangential inlet(s);

b) a conical swirl chamber attachment with a central outlet opening;

c) a conical or cylindrical, centrally arranged or eccentrically adjustable built-in part which d) forms, with the swirl chamber attachment mentioned under b), a flowthrough area which decreases continuously from the swirl chamber base to the axial outlet.

The swirl chamber will normally be operated with the axial outlet opening vertically upwards or downwards, Any inclined swirl chamber also generates a rotationally symmetrical spiral movement in the liquid on leaving the swirl chamber as a result of the compensation according to the invention.

An aerating and deaerating opening or a second outlet opening can be arranged in the center of the swirl chamber base. In this case, the conical or cylindrical built-in part does not extend to the swirl chamber base. The built-in part can of course also carry out the aeration or deaeration.

In some circumstances, the built-in part can surprisingly be forgone completely. In this case, pressure redistribution is to be ensured by corresponding inclination of the conical shell surface of the swirl chamber attachment.

In some circumstances, a flat swirl chamber cover can be used instead of the conical swirl chamber attachment. In this case, however, the built-in part to be arranged eccentrically is to be provided in any case in order to ensure the necessary pressure compensation in the swirl chamber.

The inlet cross-section can open in a tapered shape into the swirl chamber, as a result of which greater inlet speeds are achieved in comparison with an existing pipe cross-section. This also increases the speed of rotation in the swirl chamber and in the following pipe.

For certain applications, a continuous connection between two outlet openings can also be created, by the cone or cylinder being drilled through centrally or correspondingly eccentrically.

After a pipe branch, a rotationally symmetrical rotary movement of the flowing medium can be achieved in both outgoing branches which lie on a common axis. A conical built-in part is made in the form of a double cone.

It is not unappreciated that spiral flows have a number of times already been generated by means of swirl chambers (e.g. German laid open specifications 27 12 443 and 27 12 444); in these cases, however, the rotational symmetry of the spiral flow in the following axial pipe was never to the fore. In German laid open specification 36 30 536, a stable spiral fluid flow is achieved by a split flow which initiates the rotation and which is superimposed on the main flow. In contrast to this, the present invention diverts a flow by 90° and at the same time this flow is guided and redistributed in such a manner that a stable, rotationally symmetrical spiral movement arises.

The advantages achieved with the invention consist in particular in that, by means of the continuous reduction of the cross-section, which is flowed through axially, on the transition from the swirl chamber into the axial pipe, a rotationally symmetrical rotary movement is imparted to the liquid without mechanical structures or other measures. The swirl chamber shape has the effect that, in contrast to previously known swirl chamber shapes, a continuous transition from the swirl chamber base to the axial outlet is produced and a gradual pressure redistribution consequently becomes possible in association with the adjustable built-in part. In previously used and tested swirl chamber shapes for generating a rotation in a medium, the sudden transition from the swirl chamber to the axial pipe caused pressure potentials which led to a non-uniform action over the flow cross-section.

The measure according to the invention can be used particularly advantageously by means of the abovementioned method and the abovementioned device particularly as an incoming flow or upstream incoming flow stage for inlets for circular tanks sand classifiers vortex separators cleaning arrangements such as hydrocyclones vortex cleaners centrifugal force separators hydrocyclone separators centrifugal separators cyclone separators or separating chambers in general (industrial cleaning)

A particular advantage of the invention can be used in the field of water management for distributor structures for incoming water masses. Such distributor structures receive the incoming water and distribute the quantity of water to various tanks uniformly.

Also known are GB 10 67 196 and U.S. Pat. No. 31 98 214. These describe a throttling flow function but without any displaceable inner body or a displaceable built-in part. There is in these, however, an adjustable element, namely a flow body, with which the flowthrough cross-section can be regulated. The greater the water flow, i.e. the greater the speed, the greater the speed of rotation in the chamber also, which correspondingly makes the resistance rise as a result of centrifugal force, depending on the flow speed. The area of application considered in this case—and hence the throttling—is a shock absorber which is intended to lead to proportional springing in the case of strong or weak impacts.

BRIEF DESCRIPTION OF THE DRAWINGS

Evening out the outgoing flow is not envisaged, although vertical adjustment of the flow body is. An adjustment, for example horizontal, in the eccentricity of certain elements is not envisaged. On the other hand, any throttling would be extremely unfavorable according to the invention, since after all according to the invention as axial as possible an outgoing flow is to be achieved, as great a rotationally symmetrical evening out as possible is to take place, and the flow is to leave the axial pipe with a rotationally symmetrical swirl.

By way of example, embodiments of the invention are to be explained in greater detail with reference to the attached drawings, in which FIG. 1 shows a view of the flow guide according to a first embodiment;

FIG. 2 is a plan of FIG. 1;

FIG. 3 is another embodiment of a built-in element;

FIGS. 4 and 6 are other embodiments, the incoming flow according to FIG. 4 being horizontal, the outgoing flow vertically downwards, whereas the horizontal incoming flow in FIG. 6 is guided vertically upwards;

FIG. 5 is a further shape in another arrangement;

DETAILED DESCRIPTION OF THE DRAWINGS

Figure 6:
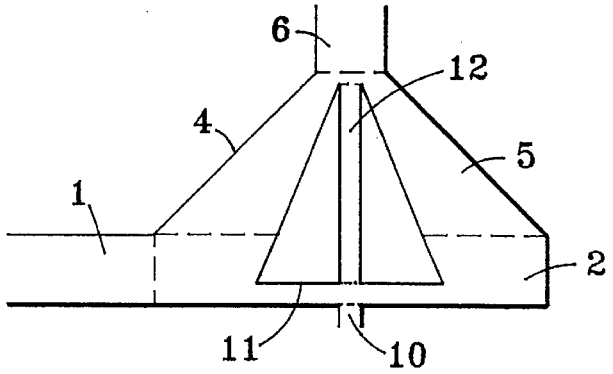

According to the embodiment in FIG. 1, a swirl chamber with a reduction in the flow cross-section is illustrated in section. The tangential swirl chamber inlet 1 opens into the swirl chamber base 2 indicated in broken lines and is guided around a built-in part 3 which is in vertical position and eccentric in relation to the swirl chamber axis. The built-in part 3 is a cylindrical built-in element which is located snugly on the swirl chamber base 2. The end side of the cylinder 3 always lies under the axial opening 6.

According to FIGS. 1 and 2, the water Q flows tangentially into the swirl chamber 5, where it moves towards the axial outlet 6 spirally in the flow cross-section between the built-in cylinder 3 and the conical swirl chamber wall 4. As a result of the reduction of the available flowing space in the flow direction in association with the eccentricity of the built-in part 3, the pressure is, with the advance of the flow, increasingly compensated over the respective cross-section by redistribution, to a given pressure-outlet-dependent region. This has the consequence that a rotationally symmetrical or any eccentric, spiral, rotary movement is formed in the axial outlet 6.

The most different of variations for swirl chamber shapes are illustrated in the various drawings.

Thus, FIG. 3 shows a swirl chamber, in which the necessary pressure redistribution is produced as a result of the flow between the cone surfaces and the shell of the swirl chamber. The cone is always more steeply inclined than the swirl chamber wall 4 surrounding it.

According to an embodiment which is not illustrated, the necessary pressure redistribution is produced even without the support by means of the building-in of a cone.

According to an embodiment which is not illustrated, the necessary pressure redistribution is produced even without the conical swirl chamber attachment if the built-in part is arranged correspondingly eccentrically in relation to the swirl chamber axis.

Figure 7:
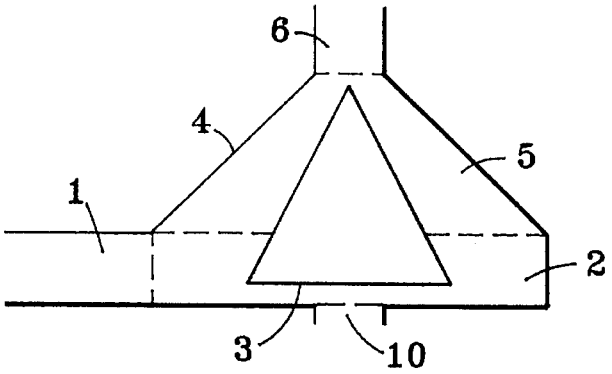
FIGS. 7 and 8 show other embodiments of the idea forming the basis of the invention.

If the outlet from the swirl chamber is to take place, for example according to FIG. 7, from two openings, the built-in part 3 (here a cone) can be fixed in such a manner that a certain distance frees the second opening 10. The rotationally symmetrical spiral movement of the flowing medium in the outlets is produced only on passing through the cross-sectional reduction of the swirl chamber 5, and not in the case of the opening 10 arranged on the swirl chamber base 2.

FIG. 4 shows an incoming flow in part from above and the outgoing flow goes axially downwards. The built-in part is a cone 11 which has a continuous bore 12. An aerating or deaerating possibility is thus afforded via the bore 12.

FIG. 5 shows a toroidal casing 7 of the swirl chamber, by means of which the pressure redistribution corresponding to the respective requirements is brought about by suitable combination with a given shape of a built-in part 8 or an appropriate cone inclination.

For different requirements, it may be advantageous or absolutely essential that—as illustrated in FIG. 6—a connection 12 exists for the built-in part 11 between the two outlets 6 and 10.

Figure 8:
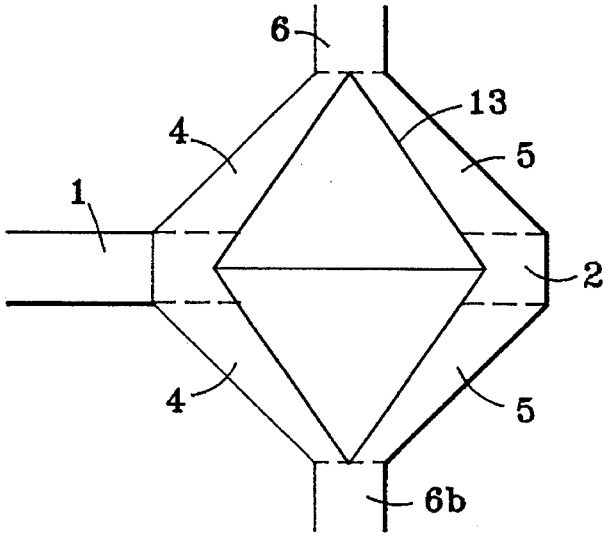

FIG. 8 shows the case in which a rotationally symmetrical rotary movement of the liquid occurs in two axial pipes 6 and **6*b*. To this end, the shell surface of the swirl chamber walling 4 is designed accordingly and a double symmetrical built-in part 13** is made.

Figure 9:
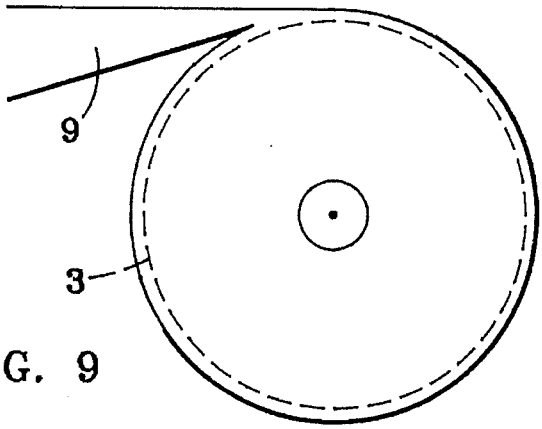
FIG. 9 is an illustration similar to FIG. 2 with another design of the incoming flow pipe.

An illustration similar to FIG. 2 is shown in FIG. 9, only the tangential inlet 9 is of narrowing or tapering design. As a result of this, the flow speed can be increased to an extent necessary for producing swirl.

The embodiment in FIG. 1, i.e. that with a smooth cylinder, can be developed in such a manner that, instead of the smooth upper cylindrical surface, the cylinder is rounded off at the top in a hemispherical, parabolic or conical shape, and the embodiment according to FIG. 1 can also be provided with an axially parallel bore.

In any case, a pressure redistribution, a guiding and stabilization of the flow and of the vortex core are ensured.

The surface of the built-in element will be smooth every time.

The cone also can have a rounded-off cone head, a parabolically rounded-off cone head, a truncated cone or a rounded-off truncated cone.

It is surprising that, by small movements for adjusting the built-in element, whether it is in the vertical direction or in the form of an eccentric, horizontal movement, the flow straightening can be influenced to such a great extent.

I claim:

1. Method, in which a tangential incoming pipe flow under pressure is imparted a spiral movement and subsequently an axial pipe flow is obtained, the incoming flow, characterized in that, to achieve virtually any spiral movement distributed over the cross-section, the incoming flow is diverted or branched, by the outgoing axial flow, which leaves, through an axial pipe, perpendicularly to the tangential incoming flow, being brought about from the latter by directing the flow, and in that a flowthrough area for the flow is tapered in the direction of the axial flow and, in a region where swirl is applied, the flow is guided around a built-in flow guide and straightener which is adjustable with regard to the eccentricity in relation to a swirl chamber axis.

2. Method according to claim 1, wherein the uniformity or non-uniformity of the axial outgoing flow is controlled by the built-in flow guide.

3. Method according to claim 1, wherein the spiral movement is set, in particular rotationally symmetrically, with the aid of the built-in flow guide.

4. Method according to claim 2, wherein the spiral movement is set, in particular rotationally symmetrically, with the aid of the built-in flow guide.

5. Method according to claim 2, wherein the pressure of the flow is redistributed in such a manner that the flow and a vortex core are stabilized with a centricity or eccentricity, which can be set as required, in relation to the axis of the axial pipe, and in that the pressure redistribution is brought about independently.

6. Method according to claim 3, wherein the pressure of the flow is redistributed in such a manner that the flow and the vortex core are stabilized with a centricity or eccentricity, which can be set as required, in relation to the axis of the axial pipe, and in that the pressure redistribution is brought about independently.

7. Method according to claim 5, wherein the pressure redistribution takes place by inclination of the tapered flowthrough area.

8. Device for diversion or branching of a pipe flow under pressure comprising a height-adjustable built-in part; a swirl chamber having a shell surface which tapers from a base region having at least one tangential inlet to at least one axial outlet of the flow with the height-adjustable built-in part positioned within the swirl chamber, whereby in that, for simultaneous action with virtually any spiral movement distributed over the cross-section and for controlling the pressure distribution in the swirl flow and thus in the at least one axial outlet opening, the built-in part is inserted into the swirl chamber and the built-in part is axially adjustably arranged substantially centrally to an axis of the swirl chamber and the adjustable built-in part is adjustable for arranging with a defined eccentricity in relation to the swirl chamber axis thereby causing control of the uniformity or non-uniformity of the axial outgoing flow.

9. Device according to claim 8, wherein the built-in part inserted into the swirl chamber is of volumetric shape selected from the group of volumetric shapes consisting of; parabolical, conical, cylindrical, polygonal shape and combinations of parabolical, conical, cylindrical and polygonal shapes, the built-in part is axially adjustably arranged substantially centrally to an axis of the swirl chamber and is adjustable for arranging with a defined eccentricity from the swirl chamber axis.

10. Device according to claim 9 further comprising two axial outlets (6, 10) arranged in the swirl chamber for dividing the incoming flow into two opposite flows.

11. Device according to claim 10, wherein the swirl chamber is of double symmetrical design (FIG. 8) for dividing the incoming flow into two flows in opposite directions.

12. Device according to claim 10, wherein the tangential inlet tapers to the swirl chamber.

13. Device according to claim 9, wherein the tangential inlet (9) tapers to the swirl chamber.

14. Device according to claim 9, wherein the swirl chamber base has a shape which is non-circular and thus also the swirl chamber shell surface is correspondingly of a shape which is corresponding and non-conical.

15. Device according to claim 9, wherein the built-in part is closed off at the top with a spherical, parabolic, conical cap.

16. Device according to claim 9, wherein the built-in part further comprises an axially directed bore therethrough substantially parallel to the swirl chamber axis.

17. Device according to claim 8, further comprising two axial outlets (6, 10) arranged in the swirl chamber for dividing the incoming flow into two opposite flows.

18. Device according to claim 17, wherein the swirl chamber is of double symmetrical design (FIG. 8) for dividing the incoming flow into two flows in opposite directions.

19. Device according to claim 17, wherein the tangential inlet (9) tapers to the swirl chamber.

20. Device according to claim 8, wherein the tangential inlet (9) tapers to the swirl chamber.

21. Device according to claim 8, wherein the tangential and the axial outlet opening are of different sizes.

22. Device according to claim 8, wherein at least one of the outlet openings is designed as an axial pipe piece which is widened in a diffuser-like manner.

* * * * *